United States Patent [19]

Lewandowski et al.

[11] 4,065,853

[45] Jan. 3, 1978

[54] PORTABLE PUNCH AND DIE JIG

[75] Inventors: Edward F. Lewandowski, Westmont; Petrus A. Anderson, Palos Heights, both of Ill.

[73] Assignee: The United States of America as represented by the United States Energy Research and Development Administration, Washington, D.C.

[21] Appl. No.: 763,169

[22] Filed: Jan. 27, 1977

[51] Int. Cl.[2] ..... B26F 1/00

[52] U.S. Cl. ..... 30/361

[58] Field of Search ..... 30/361, 363, 358, 368

[56] References Cited

U.S. PATENT DOCUMENTS

| | | | |
|---|---|---|---|
| 236,956 | 1/1881 | Nuebling | 30/358 |
| 917,739 | 4/1909 | Owens | 30/358 |
| 3,253,493 | 5/1966 | Weisbeck | 30/358 |
| 3,906,633 | 9/1975 | Inoue | 30/358 |

*Primary Examiner*—James L. Jones, Jr.

*Attorney, Agent, or Firm*—Dean E. Carlson; Frank H. Jackson

[57] ABSTRACT

A portable punch and die jig includes a U-shaped jig of predetermined width having a slot of predetermined width in the base thereof extending completely across the width of the jig adapted to fit over the walls of rectangular tubes and a punch and die assembly disposed in a hole extending through the base of the jig communicating with the slot in the base of the jig for punching a hole in the walls of the rectangular tubes at precisely determined locations.

1 Claim, 4 Drawing Figures

PORTABLE PUNCH AND DIE JIG

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to a portable punch and die jig for use in punching holes in the walls of small-diameter tubes at precisely determined locations.

Punching a hole in the wall of tubing of limited diameter at precisely the same location in a large number of such tubes so that complete uniformity can be obtained is not easy.

Such a problem arises in connection with the construction and operation of ZPR-6 and ZPR-9 which are zero-power research reactors located at Argonne National Laboratory, Argonne, Illinois.

These reactors consist of a large number of horizontally disposed tubes in which drawers containing nuclear materials are slidably disposed. The tubes are about 2 inches square having walls 0.040 inch in thickness and are welded together in groups of 25 in a square matrix. The matrix is split into two halves and the drawers contain sufficient nuclear fuel that criticality is attained when the halves of the reactor are moved together. Fuel and other nuclear materials are loaded into the proper drawers to simulate a desired reactor configuration. When Zero-Power Reactors are operated with uranium in the drawers, no cooling is required. When plutonium is placed in the drawers to simulate a plutonium-fueled configuration, cooling of the plutonium-filled drawers is required, this being accomplished by an air draft flowing through the tubes toward the rear face of the matrix. Even though the drawers are very heavy, the very remote chance that the plutonium-filled drawers might creep along the tubes due to the air draft and ultimately fall out of the tubes is one that cannot be tolerated. Thus safety considerations demand the installation of drawer stops in each tube of the existing ZPR matrix. To accomplish this, holes must be drilled or punched in the walls of these tubes near the rear face thereof at precisely determined locations.

No commercially available hand drills are known which would do the job. Also, the use of a drill of any kind would create complications due to the formation of a burr at the edge of the hole, the formation of chips and the requirement for a lubricant. Thus use of a punch and die is indicated.

Commerically available punches are not acceptable due to the small size of the tube, the requirement for accurate positioning of the hole and the need for applying considerable leverage to the punch so that punching can be accomplished manually.

It will be observed that the problem described above arose in connection with a matrix of tubes which were already welded in place. To punch each tube before incorporation in the matrix would simplify matters in some ways but would require very careful placement of the tubes in the matrix so that holes in adjacent tubes lined up so that a drawer stop could be placed therein.

While the portable punch and die jig has been described herein with respect to a specific problem which arose in the course of operation of a Zero-Power Reactor, it will be at once appreciated that the tool of the present invention is not limited to such use but could be used anywhere a similar problem arose.

DESCRIPTION OF THE INVENTION

Figure 1:
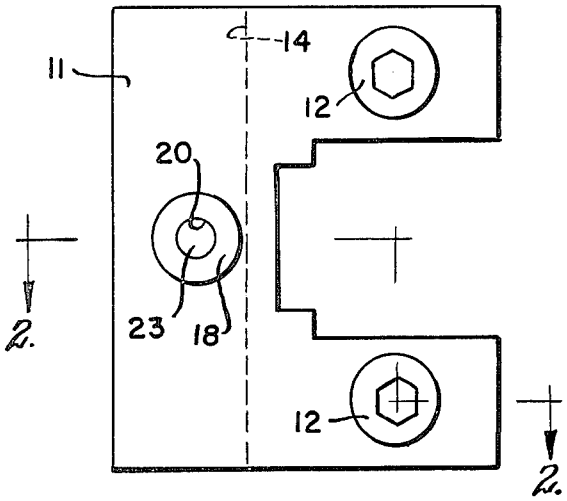
FIG. 1 is a top plan view of a portable punch and die jig according to the present invention.
Figure 2:
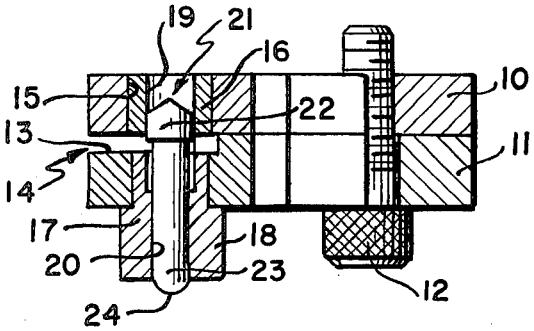
FIG. 2 is a sectional view thereof taken on the line 2—2 in FIG. 1 showing the punch in position.

As shown in FIGS. 1 and 2, the portable punch and die jig of the present invention comprises two flat, congruent, U-shaped members 10 and 11 held together by screws 12 extending through the arms thereof, member 11 being thicker than member 10, the thicker member having a cut-out portion 13 on the inner face thereof extending across member 11 and extending deep into the base of member 11 to create a deep slot 14 in the bottom of the U-shaped jig. Slot 14 is formed entirely in thicker member 11 both for convenience and so that the wall held therewithin for punching is clamped against the edge of member 10 by member 11.

A hole 15 extends completely through the base of the U-shaped jig in the region of slot 14, the hole being of slightly smaller diameter in the wider member 11 than in the narrower member 10. This is simply to reduce the size and weight of the insert therein. Case hardened inserts 16 and 17 respectively are force-fitted into members 10 and 11 to serve as liners for hole 15, the exterior and interior ends of insert 16 being flush with the surface of member 10, the interior end of insert 17 being flushed with the surface of cut-out portion 13 of member 11 and insert 17 including an enlarged portion 18 outside of the jig member. A cavity 19 extends through insert 16 and into insert 17, there being an axial opening 20 of smaller diameter than the cavity extending the remainder of the way through insert 17.

A punch 21 consists of a head 22 of the same diameter as the cavity 19 and movable therein and a stem 23 extending through axial opening 20 to terminate out of the jig. The circumference of the surface of head 22 is the cutting edge of the punch. The surface is tapered to a noncutting ridge wherefor the cutting edge comes in contact with the wall gradually instead of all at once. The amount of pressure required to punch a hole is substantially less than would be required if the punch head had a flat surface. Stem 23 has a rounded tip 24 for a reason which will be made clear hereinafter.

Figure 3:
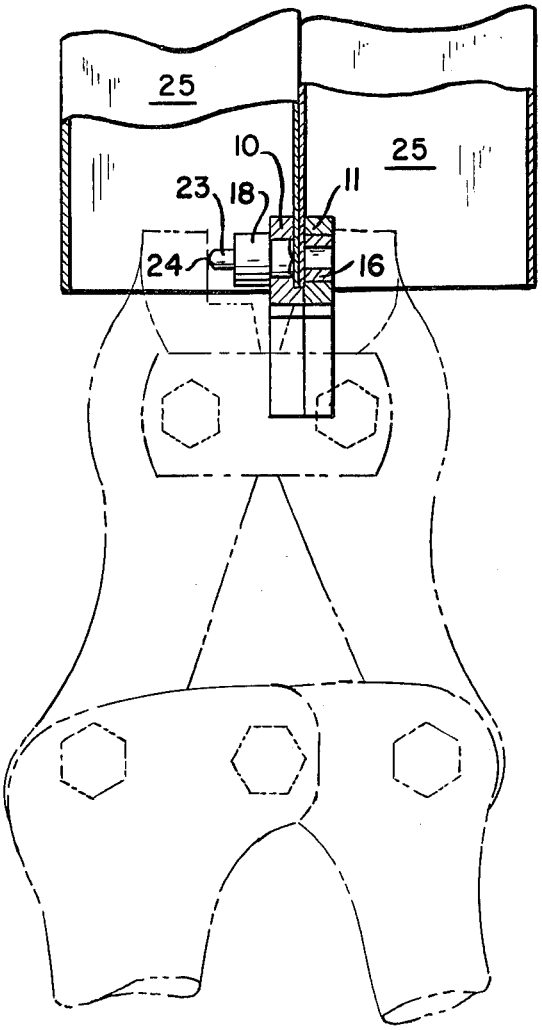
FIG. 3 is a perspective view of a section of a zero power reactor including a punch and die jig as claimed herein to illustrate utilization of the jig.
Figure 4:
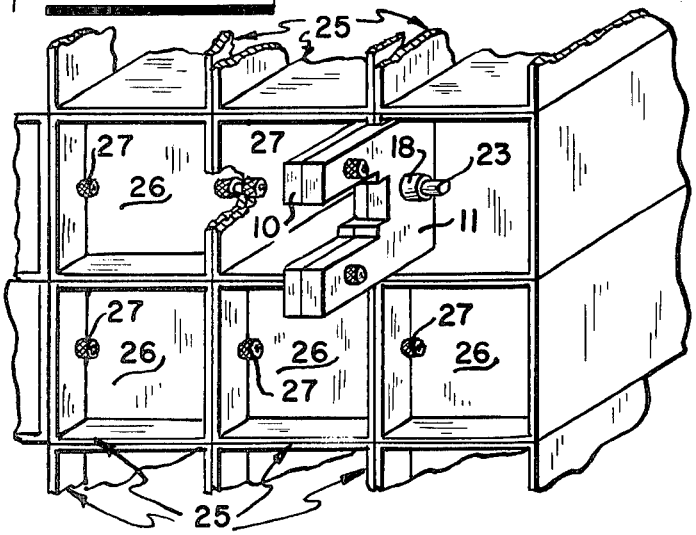
FIG. 4 is a section taken on the horizontal plane 4—4 in FIG. 3.

Utilization of the punch and die jig will be made clear by referring to FIGS. 3 and 4 of the drawing. As shown in FIG. 3, a Zero-Power Reactor includes a large number of 2-inch square tubes 25 welded together in a bundle, the bundles being stacked to form the reactor, each tube containing a drawer 26 conforming in size and shape or tubes 25 and containing nuclear materials. To ensure that all drawers are disposed in the same relative location in each tube, stops 27 consisting of cap screws in holes in the walls of tubes 25 are provided at precisely the same distance inwardly from the rear (noncharging) face of the reactor. Thus it is necessary to punch a hole in a wall of each tube at precisely the same location. For the specific problem at hand, these holes are 3/16 inch in diameter.

The portable punch and die jig as described above together with a tool to be described is employed to accomplish this. The width of the jig is determined by the width of tubes 25 so that the jig will just fit in a tube without forcing and the width of slot 14 is slightly smaller than the thickness of two joined walls so that the jig can be clamped over the element to be punched. A jig of the proper size is then slipped over the walls of the tube as far as it will go as in a tongue and groove joint, thereby precisely locating the punch and die assembly with respect to the wall and the screw 12 is tightened. The punch is operated manually with a special tool adapted from a conventional cable crimper to include a head having opposing flat faces. The head of this tool is placed over the punch and die assembly and pressure is applied manually to the end of the tool to operate the punch. The rounded tip 24 of the punch 23 is provided since the opposing flat faces of the special tool approach the punch in an arcuate path. The rounded tip ensures good point contact between the tip of the punch and the flat face of the tool.

Following the punching operation, the punch 21 is manually driven on through the jig as with a ball-type Allen wrench, the screw 12 is slightly loosened, the jig removed from its location on the wall, and the punch reinserted into the hole 19 for use on the next tube.

The embodiments of the invention in which an exclusive property or privilege is claimed are defined as follows:

1. A punch and die jig for use in punching holes in the walls of rectangular tubes at precisely determined locations comprising two flat, congruent, U-shaped jig members of width just sufficient to fit in the tube without forcing, one of said jig members being thicker than the other, the thicker member having a cut-out portion on the inner face thereof extending across the member and extending deep into the member, means for holding the two jig members together, thereby creating a deep slot in the base of the jig, a punch and die assembly disposed in a hole in the base of the jig, which hole communicates with the slot, the hole being of slightly greater diameter in the narrower jig than in the wider, case hardened inserts lining the hole and having a cavity therein, the insert in the narrower jig member serving as the die of the punch and die assembly, the insert in the wider jig member including an enlarged portion outside of the jig member, a punch having a head movable within the cavity and a stem protruding above the top of the insert in the wider jig member, said punch and die when actuated cooperating to punch a hole in the wall of a tube interposed between the punch and the die.

* * * * *